US005285130A

United States Patent [19]

Takayama

[11] Patent Number: 5,285,130

[45] Date of Patent: Feb. 8, 1994

[54] ELECTRON GUN WITH BI-POTENTIAL FOCUSING LENS AND ELECTROSTATIC DEFLECTION PLATES

[75] Inventor: Shigehiko Takayama, Hachioji, Japan

[73] Assignee: Hitachi, Ltd., Tokyo, Japan

[21] Appl. No.: 668,102

[22] Filed: Mar. 12, 1991

[30] Foreign Application Priority Data

Mar. 12, 1990 [JP] Japan ..... 2-057967

[51] Int. Cl.[5] ..... H01J 29/74

[52] U.S. Cl. ..... 313/414; 313/413; 313/432; 313/439

[58] Field of Search ..... 313/414, 413, 432, 439, 313/437, 422, 428; 315/17

[56] References Cited

U.S. PATENT DOCUMENTS 4,621,215 11/1986 Tanaka ..... 313/422

4,763,047 8/1988 Watanabe et al. ..... 315/382

FOREIGN PATENT DOCUMENTS 49-5591 7/1974 Japan .

*Primary Examiner*—Donald J. Yusko

*Assistant Examiner*—Michael Horabik

*Attorney, Agent, or Firm*—Antonelli, Terry, Stout & Kraus

[57] ABSTRACT

A one-gun three-beam electron gun comprises a triode part controlling an electron source generating a plurality of electron beams and emission of the electron beams generated by the electron source; a main electron lens of bi-potential focusing type consisting of not less than two cylindrical electrodes focusing the plurality of electron beams emitted by the triode part; electrostatic deflection plates disposed on the screen side of the main electron lens; and electrostatic deflection plates disposed on the electron source side of the main electron lens.

8 Claims, 9 Drawing Sheets $V_{G3}:V_{G4}=10:33$ $V_{G3}:V_{G4}=10:33.8$ $V_{G3}:V_{G4}=10:33.9$ $V_{G3}:V_{G4}=10:32.5$ $V_{G3}:V_{G4}=10:32.6$ $V_{G3}:V_{G4}=10:32.9$ $V_H:V_{G4}=10:3.29$ $V_H:V_{G4}=10:3.33$ $V_H:V_{G4}=10:3.28$ $V_H:V_{G4}=10:3.48$ $V_H:V_{G4}=10:3.45$ $V_H:V_{G4}=10:3.39$

ELECTRON GUN WITH BI-POTENTIAL FOCUSING LENS AND ELECTROSTATIC DEFLECTION PLATES

BACKGROUND OF THE INVENTION

The present invention relates generally to an electron gun, and more in detail to an electron gun device suitable for a cathode ray tube such as a color picture tube and a color display tube. More specifically it relates to a color cathode ray tube using a single electron gun generating a plurality of beams.

Accompanied by enlargement of the screen and high definition of the image in a color picture tube device, a color cathode ray tube having a reduced aberration provided with a larger aperture electron lens is required. As a color cathode ray tube suitable for this requirement, a color cathode ray tube is known which as a single electron gun generating a plurality of beams. This electron gun has an electrode structure as indicated in FIG. 14 (disclosed e.g. in JP-B-Sho 49-5591). As indicated in the figure, for the cathodes $K_R$, $K_G$ and $K_B$ arranged along the X-axis, corresponding to the different colors, red, green and blue, respectively, there are disposed in common a first electrode $G_1$, a second electrode $G_2$, a third electrode $G_3$, a fourth electrode $G_4$ and a fifth electrode $G_5$. The cathodes, the first electrode $G_1$ and the second electrode $G_2$ constitute a triode part. The third electrode $G_3$, the fourth electrode $G_4$ and the fifth electrode $G_5$, all of which are cylindrical, form a main electron lens of unipotential focusing type by applying a focusing voltage $V_{G4}$ to the fourth electrode $G_4$ and a same voltage $V_H$ to the third electrode $G_3$ and the fifth electrode $G_5$. The cathodes $K_R$, $K_G$ and $K_B$ are so arranged that the electron beams therefrom intersect each other at a position, where the Fraunhofer condition (condition that the coma is zero) is satisfied approximately at the center of the main electron lens. Further the three electron beams $B_G$, $B_R$ and $B_B$ are converged on the screen by electrostatic deflection plates A and B disposed in a stage succeeding the fifth electrode $G_5$.

However, the uni-potential focusing lens has a drawback that if it is attempted to improve the aberration characteristics for the electron beam from the cathode $K_G$, i.e. the center beam $B_G$, the aberration characteristics are worsened for the electron beams from the cathodes $K_R$ and $K_B$, i.e. the side beams $B_R$ and $B_B$. This takes place for the reason described below. That is, in the uni-potential lens, since three electrodes are used as described above, it is possible to lengthen the acting region of the lens by increasing the length of the middle electrode. Therefore, it is possible to decrease the spherical aberration for the center beam $B_G$ by making the lens weaker by lengthening the acting region of the lens. However, since the side beams $B_R$ and $B_B$ enter the lens obliquely, if the acting region of the lens is long, a great astigmatism is produced, corresponding thereto. For this reason it is not possible to reduce the size of the spots for the side beams, even if the ratio of the electrode voltages is varied. That is, for a one-gun three-beam electron gun using the prior art uni-potential lens there was a limit of improving the aberration characteristics both for the center beam and for the side beams.

On the other hand, it is important also to decrease the depth of the color cathode ray tube.

SUMMARY OF THE INVENTION

Therefore, an object of the present invention is to provide a one-gun three-beam electron gun having excellent aberration characteristics both for the center beam and for the side beams, forming small beam spots.

Another object of the present invention is to realize a color cathode ray tube having excellent aberration characteristics for the beams, in which the electron gun is short in the beam direction and the depth is small.

In order to achieve the above and other objects, in a cathode ray tube having a one-gun three-beam electron gun according to the present invention, the electron gun comprises: a triode part controlling an electron source generating a plurality of electron beams and emission of the electron beams generated by the electron source; a main electron lens of bi-potential focusing type consisting of not less than two cylindrical electrodes focusing the plurality of electron beams emitted by the triode part; electrostatic deflection plates disposed on the screen side of the main electron lens for convergence; and electrostatic deflection plates disposed on the electron source side of the main electron lens.

According to the present invention, by using a bi-potential focusing lens for the main electron lens, it is possible to reduce the size of the spots of the center beam and the side beams owing to excellent aberration characteristics of the bi-potential focusing lens. In addition, it is possible to make the astigmatism produced by the electrostatic deflection plates disposed on the electron source side of the main electron lens and the astigmatism produced by the electrostatic deflection plates for convergence compensate each other, while making the most of the excellent aberration characteristics of the bi-potential focusing lens.

Further, the incident angle of the side beams to the main electron lens can be steeper owing to the electrostatic deflection plates disposed on the electron source side of the main electron lens. As a result, the outgoing angle of the side beams from the main electron lens can be increased even with the bi-potential focusing lens. Consequently it is possible to realize the separation of the side beams from the center beam over a relatively short distance and thus the electrostatic deflection plates for convergence can be located at a position close to the main electron lens. In this way, even though a bi-potential focusing lens is used, it is possible to realize a cathode ray tube having a small depth without causing an increase in the total length of the electron gun.

DESCRIPTION OF THE PREFERRED EMBODIMENTS

Figure 1:
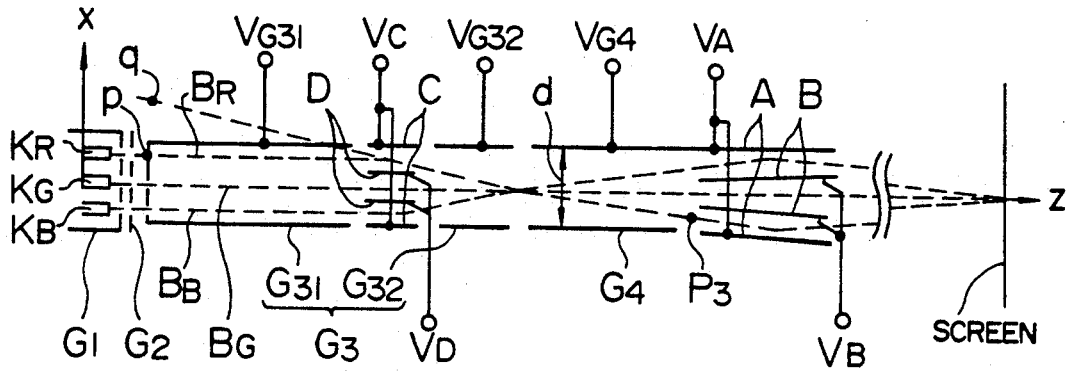
FIG. 1 is a scheme indicating the construction of the electrodes in an embodiment of the electron gun according to the present invention.
Figure 2:
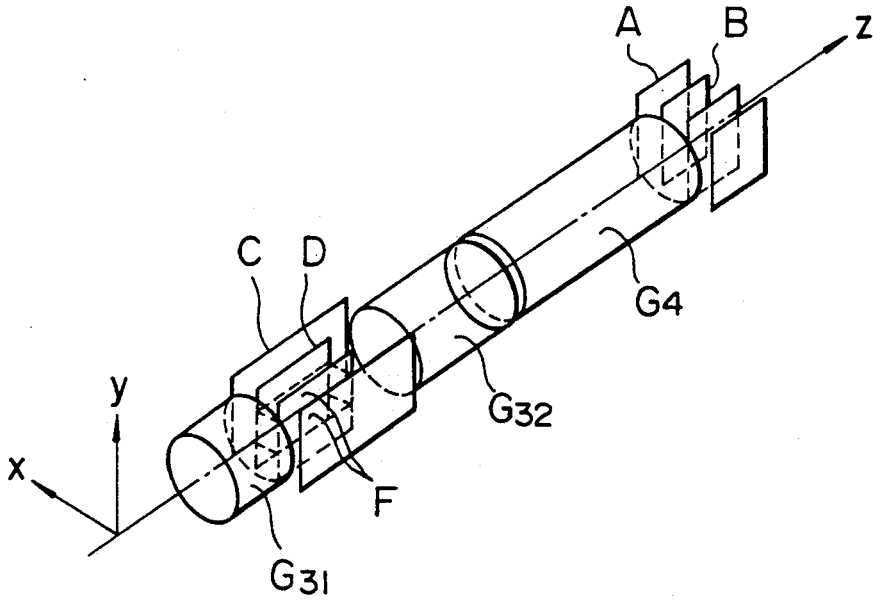
FIG. 2 is a perspective view showing the principal part of the embodiment indicated in FIG. 1.

FIG. 1 is a scheme indicating the construction of the electrodes in an embodiment of the electron gun for a cathode ray tube according to the present invention. FIG. 2 is a perspective view showing the principal part of the embodiment indicated in FIG. 1. For the cathodes $K_R$, $K_G$ and $K_B$ arranged along the X-axis, corresponding to the different colors, red, green and blue, respectively, there are disposed in common a first electrode $G_1$, a second electrode $G_2$, a third electrode $G_3$ and a fourth electrode $G_4$. The cathodes, the first electrode $G_1$ and the second electrode $G_2$ constitute a triode part, and the third electrode $G_3$ and the fourth electrode $G_4$, both of which are cylindrical, form a main electron lens of a bi-potential focusing type. The third electrode $G_3$ is divided into two parts, electrode $G_{31}$ and electrode $G_{32}$, in the Z-direction along the central axis. Electrode plates C and D are two pairs of first deflection plates, which are disposed between the electrode $G_{31}$ and the electrode $G_{32}$. They are so disposed that the side beams $B_R$ and $B_B$ pass through between the two first deflection plates of the two pairs, respectively. Electrodes A and B are two pairs of the second deflection plates, which are disposed for converging the side beams $B_R$ and $B_B$, which have passed through the main electron lens, on a screen. The side beams $B_R$ and $B_B$ move forward within the triode part parallelly to the center beam $B_G$. A voltage $V_{G31}$ is applied to the electrode $G_{31}$; a voltage $V_{G32}$ is applied to the electrode $G_{32}$; a voltage $V_{G4}$ is applied to the electrode $G_4$; a voltage $V_A$ is applied to the deflection plates A; a voltage $V_B$ is applied to the deflection plates B; a voltage $V_C$ is applied to the deflection plates C; and a voltage $V_D$ is applied to the deflection plates D, for which $V_{G31}=V_{G3}=V_C$, giving a focus voltage. Further $V_{G4}=V_B$, $V_A<V_B$ and $V_C<V_D$.

Now, based on an electron gun fabricated on trial in practice according to the present invention, aberration characteristics for the center beam and the effect of the first deflection plates C and D on the side beams will be explained.

The size of the electrodes of the electron gun fabricated on trial is as follows. Normalized by the inner diameter d of the electrode, the length of the electrode $G_{31}$ is 2.65d; the length of both the first deflection plates C and D is 0.7d; the length of the electrode $G_{32}$ is 1.0d; the length of the fourth electrode $G_4$ is 2.0d; the length of both the second deflection plates A and B in the axial direction is 1.8d; the length from the cathode side end of the electrode $G_{31}$ to the screen side end of the second deflection plates is 8.75d; the distance from the cathode side end of the electrode $G_{31}$ to the screen is 36.4d; and the space between the deflection plates A and B as well as the deflection plates C and D in the X-direction is 0.35d. The distance between each of the outgoing side beams $B_R$, $B_B$ and the outgoing center beam $B_G$ in the X-direction is 0.35d.

Figure 3:
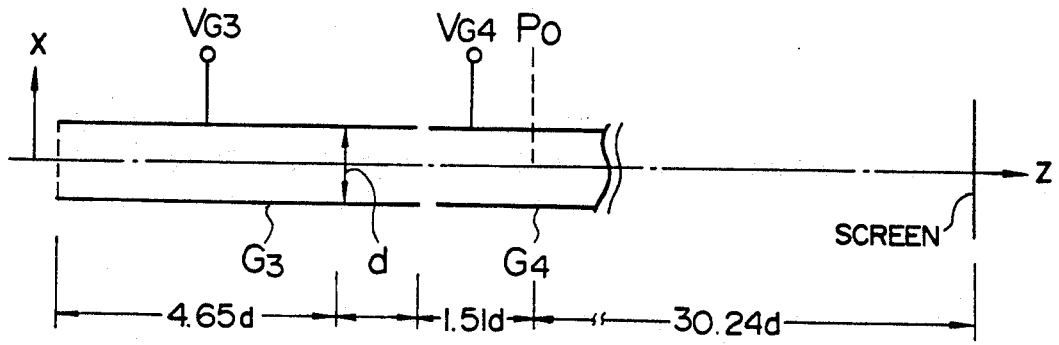
FIG. 3 is a scheme indicating an electrode construction of the bi-potential focusing lens of the embodiment.

FIG. 3. indicates the electrode construction of the bi-potential focusing lens used in the example fabricated on trial described above for explaining the characteristics of the center beam. Although the deflection plates C and D are inserted between the electrodes G31 and G32 of the third electrode $G_3$ in the electrode construction of the present embodiment, they are not drawn in the figure.

In the case of the bi-potential focusing lens, the high voltage $V_{G4}$ is applied to the fourth electrode $G_4$ and the focus voltage $V_{G3}$ is applied to the third electrode $G_3$. The length of the third electrode is 4.65d; the distance from the screen side end of the third electrode $G_3$ to the exit $p_0$ of the main electron lens is 1.51 d; and the distance from the exit $p_0$ of the main electron lens to the screen is 30.24d.

Figure 4:
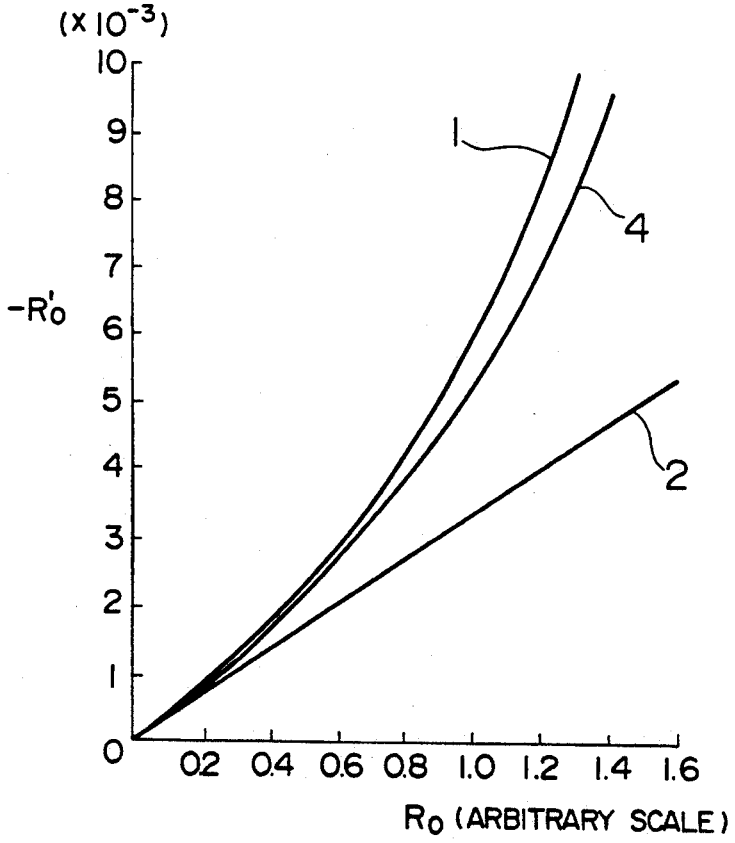
FIGS. 4, 5 and 6 are schemes for explaining characteristics of a bi-potential focusing lens and a uni-potential focusing lens.

FIG. 4 shows variations in the gradient of the electron beam $-R_0'$ (' represents differential with respect to the central axis Z) with respect to the spread radius $R_0$ of the electron beam at the exit $p_0$ of the main electron lens. In the same figure, a curve 4 represents the aberration characteristics of the bi-potential focusing lens used in the example fabricated on trial. The straight line 2 represents characteristics for an ideal main electron lens having no aberration. A curve 1 represents the characteristics of a prior art uni-potential main electron lens under an almost same condition as the example fabricated on trial for the present embodiment. That is, the example fabricated on trial for the present embodiment and the prior art main electron lens using a uni-potential focusing lens are identical in the point that the inner diameter of the electrodes is d; the distance from the exit $p_0$ of the main electron lens to the screen is 30.24d; the position of the object point is set at the cathode (not indicated in the figure) side end of the third electrode $G_3$ on the central axis Z and in the angle magnification of the electron beam from the object point to the screen (for this reason, the thermal spread of the electron beam and the spread of the spot by the space charge effect remain identical). Therefore it is possible to compare uniquely the spread purely due to the aberration therebetween. From this figure it can be understood that the characteristic curve 4 of the bi-potential focusing lens approaches the straight line 2 for the lens having no aberration and that better aberration characteristics of the center beam can be obtained than the prior art uni-potential focusing lens.

Figure 5:
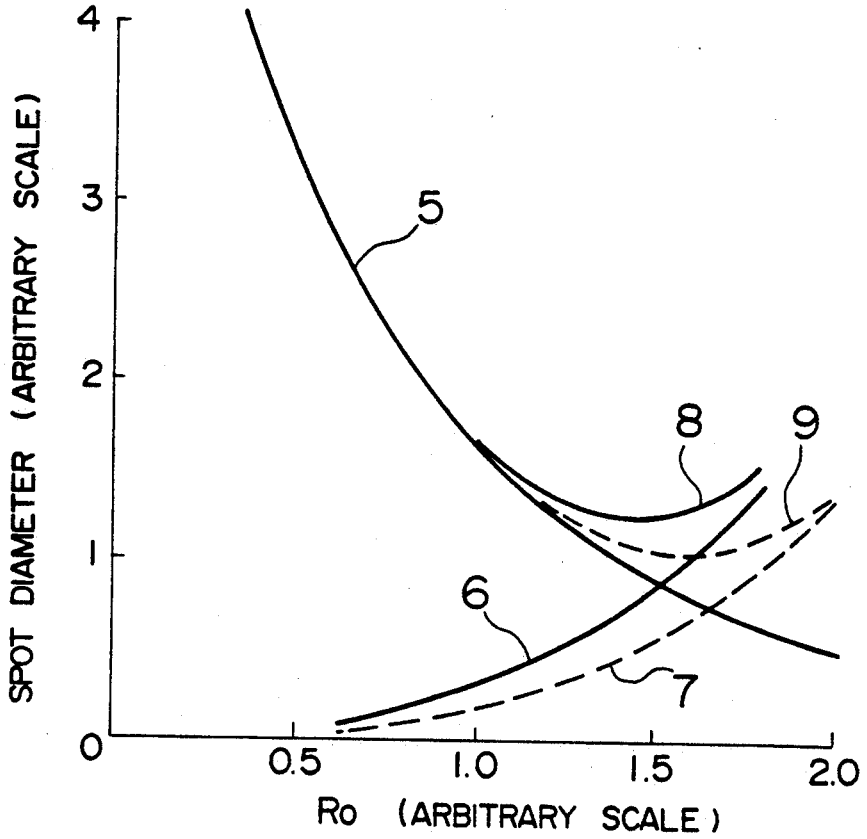

FIG. 5 is a scheme for explaining an improving effect of the present invention on the spot diameter on the screen. The figure indicates variations in the spot diameter obtained by adding the spread of the beam spot due to the thermal spread and to the space charge effect to the spread of the beam spot due to the aberration with respect to the spread radius $R_0$ of the electron beam at the exit $p_0$ of the main electron lens. Here a curve 5 represents the spot diameter due to the thermal spread and the space charge effect. Curves 6 and 7 represent spot diameters obtained by means of the prior art unipotential focusing lens and the bi-potential focusing lens of the present example fabricated on trial, respectively. Curves 8 and 9 represent variations in the spot diameter obtained by adding the spread due to the thermal spread and the space charge effect to the spread due to the aberration of the prior art uni-potential focusing lens and the bi-potential focusing lens of the present example fabricated on trial, respectively. The spot diameter can be decreased by about 15% at the smallest diameter by the bi-potential focusing lens of the present example with respect to that obtained by the prior art uni-potential focusing lens. In addition, while the image magnification (projection magnification) of the object point is about 9 for the uni-potential focusing lens, it is about 5 for the bi-potential focusing lens, i.e. it can be reduced to a half. Consequently the spot diameter as a whole obtained by the bi-potential focusing lens fabricated for the present example is considerably smaller than that obtained by the prior art uni-potential focusing lens.

Figure 6:
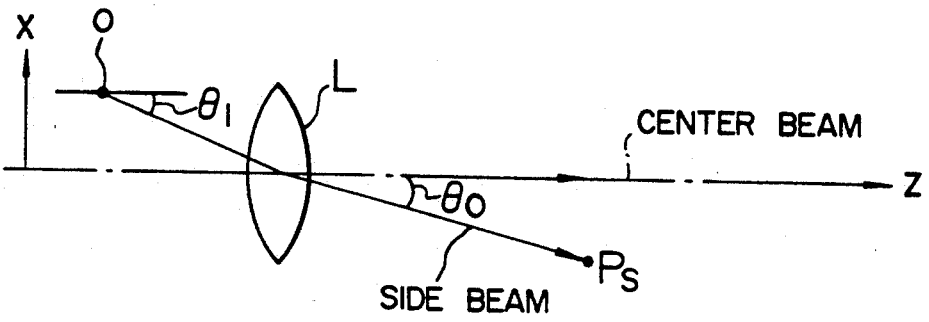

Next the effect of the deflection plates C and D on the side beams in the present embodiment will be explained, referring to FIG. 6. In general, the relation between the incident angle $\theta_i$ of the side beam to the main electron lens L and the outgoing angle $\theta_o$ from the main electron lens is expressed by $\theta_i \approx \theta_o$ for the uni-potential focusing lens and by $\theta_i > \theta_o$ for the bi-potential focusing lens. For the fabrication the deflection plates A and B, which are convergence means should be located at a position $p_S$, from which the side beams and the center beam are distant in some degree. Here the position of $p_S$ is so determined that the distance from the central axis Z to $p_S$ and the distance from the central axis Z to the position 0 (object point), at which the side beam is emitted, are equal to each other. For a same incident angle $\theta_i$, $p_S$ is located at a position more distant from the main electron lens L by the bi-potential focusing lens than by the uni-potential focusing lens. Further, as described previously, in order to have a same angle magnification of the electron beam as that obtained by the uni-potential focusing lens, the distance between the main electron lens L and the object point 0 should be longer than that required for the uni-potential focusing lens. For this reason, the third electrode becomes longer. Consequently, if the bi-potential focusing lens having no deflection plates C and D were applied, as it is, a problem would take place that increase in the total length of the electron gun is caused. Therefore, by the electrode construction in the present embodiment, as indicated in FIG. 1, the third electrode is divided into two parts in the Z-direction along the central axis, i.e. electrode $G_{31}$ and electrode $G_{32}$ and the deflect plates C and D are inserted therebetween. By such an electrode construction the side beam $B_R$ advancing parallelly to the center beam $B_G$ is emitted at a position q virtually sufficiently more distant from the central axis than the real object point p. In this way, since the incident angle $\theta_i$ to the main electron lens can be taken large, the outgoing angle $\theta_o$ from the main electron lens can be also large. For this reason, the separation position $p_S$ of the side beams from the center beam can be made closer to the main electron lens L.

Figure 7A:
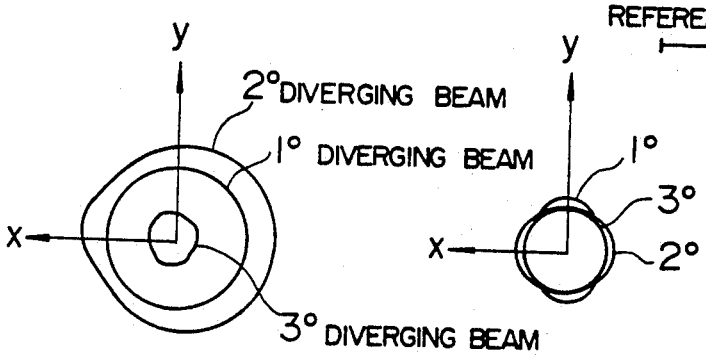
FIGS. 7A to 7F are schemes for explaining characteristics of the beam spot produced by the electron gun according to the present invention.
Figure 7B:
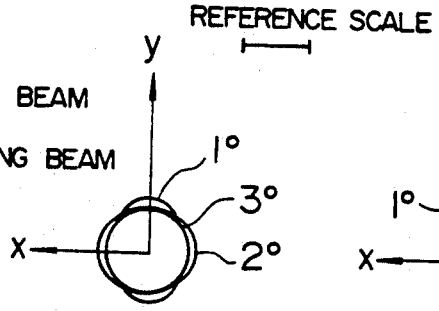
Figure 7C:
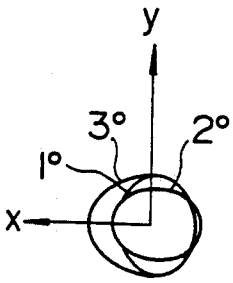
Figure 7D:
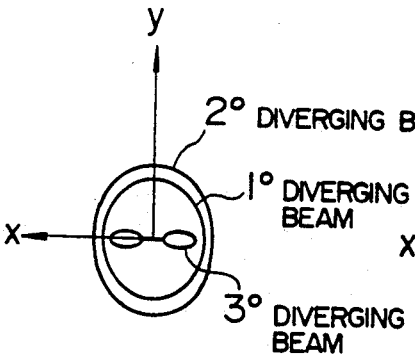
Figure 7E:
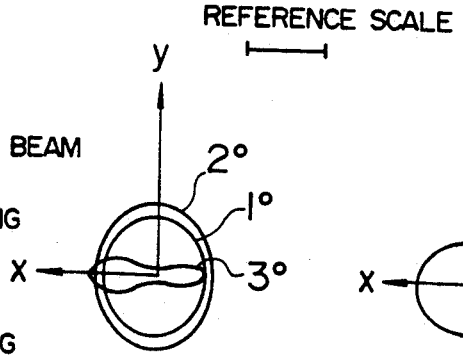
Figure 7F:
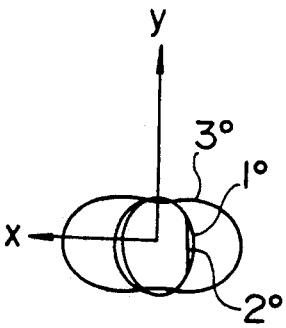

FIGS. 7A to 7F indicate characteristics of the side beams for the example fabricated on trial of the electron gun described above. FIGS. 8A to 8F indicate characteristics of the side beams by the uni-potential focusing lens for comparison. FIGS. 3A to 3C show spot characteristics of an electron beam divergent from one point with divergence angles (half angle) of 1°, 2° and 3° at a position, which is distant by 0.35d in the X-direction from the central axis Z at the cathode (not show in the figure) side end of the third electrode $G_3$. That is, they show variations in the spot shape on the screen of an electron beam entering obliquely a position in the neighborhood of the center of the main electron lens, satisfying the Fraunhofer condition (condition of coma zero), using parameters of the ratio of the voltages applied to the third and the fourth electrode $V_{G3}$; $V_{G4}$ (without taking convergence into account). FIGS. 7D to 7F show variations in the spot shape, in the case where the object point 0 is located at a position, which is 3 times as distant as the object point for FIG. 7A, i.e. when it is located at a position, which is distant by 1.05d from the central axis Z (corresponding to virtual object points q for the side beams $B_R$ and $B_B$ emitted by the cathodes $K_R$ and $K_B$ by the effect of the first deflection plates C and D in the present embodiment). Here the incident angle of the electron beam to the main electron lens is 12.6° (Fraunhofer condition), which is more than about 2 times as large as the incident angle obtained by using the uni-potential focusing lens, which is 5.5° to 6°.

Figure 8A:
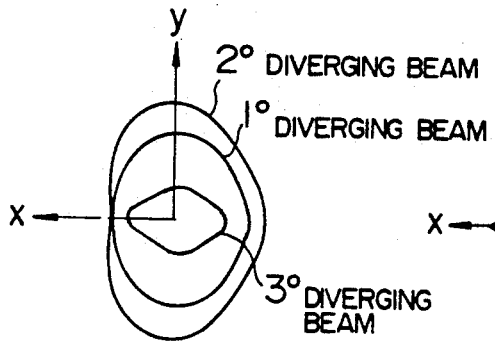
FIG. 8A (PRIOR ART)
FIGS. 8A to 8F are schemes for explaining characteristics of the beam spot produced by using the prior art uni-potential focusing lens.
Figure 8B:
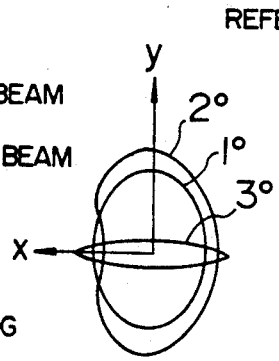
FIG. 8B (PRIOR ART)
Figure 8C:
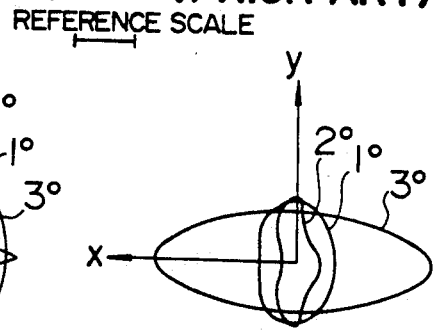
FIG. 8C (PRIOR ART)
Figure 8D:
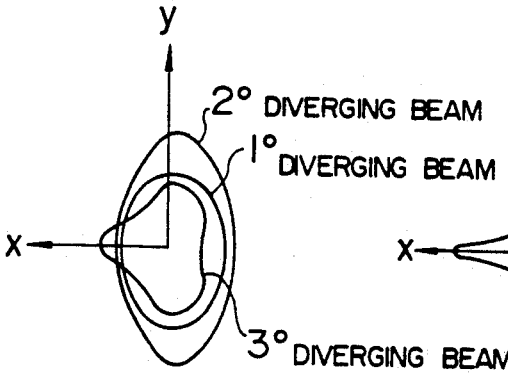
FIG. 8D (PRIOR ART)
Figure 8E:
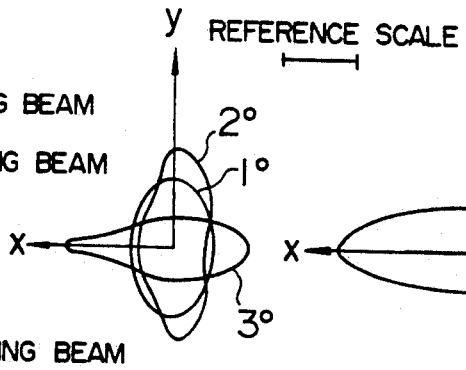
FIG. 8E (PRIOR ART)
Figure 8F:
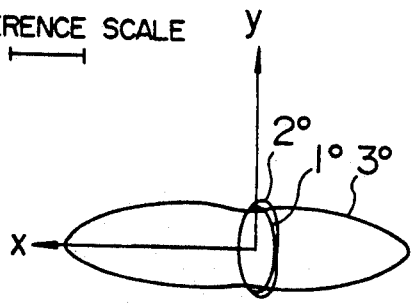
FIG. 8F (PRIOR ART)

FIGS. 8A to 8C as well as FIGS. 8D to 8F indicate variations in the spot shape of an electron beam divergent from one point with divergence angles (half angle) of 1°, 2° and 3° at a position, which is distant by 0.35d in the X-direction from the central axis Z at the cathode (not shown in the figure) side end of the third electrode $G_3$ for the uni-potential focusing lens, similarly to the case indicated in FIGS. 7A to 7F. FIGS. 8A to 8C show variations in the spot shape, when the length of the fourth electrode is 1.05d, while FIGS. 8D to 8F show variations in the spot shape, when the length of the fourth electrode 1.45d.

Comparing FIGS. 7A to 7F with FIGS. 8A to 8F, it can be found that the astigmatism is smaller for the bi-potential focusing lens than for the prior art uni-potential focusing lens. It can be understood that the spot shape obtained by the bi-potential focusing lens is more round than the spot shape obtained by the prior art uni-potential focusing lens and has a smaller spot diameter than the latter. Consequently, by the present embodiment it was possible to improve the aberration characteristics of not only the center beam but also the side beams with respect to those obtained by the prior art technique without causing an increase in the total length.

Further, concerning the position where the first deflection plates C and D are located, as the result of various studies on the spot characteristics of the side beams, it was found preferable that, in particular in order to lead the side beams emitted by the triode part suitably between the deflection plates C and D, the distance from the center position of the main electron lens (middle point between the electrode $G_{32}$ and the electrode $G_4$) to the center position of the deflection plate C is greater than 1.5d.

Figure 9:
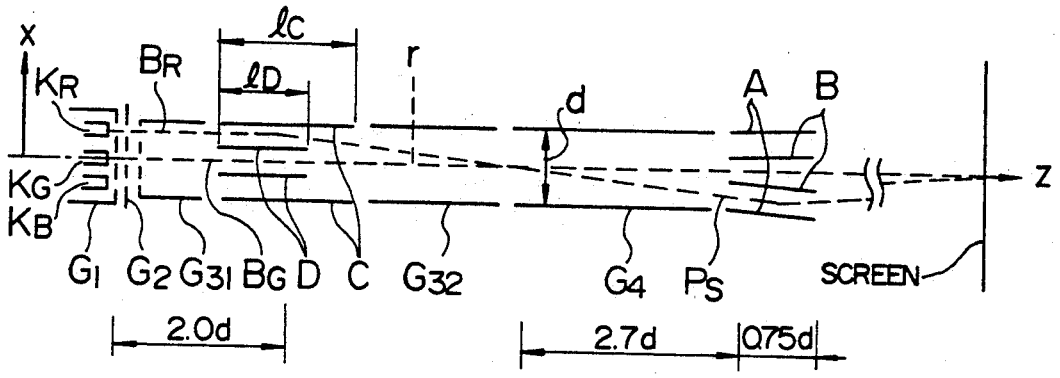
FIG. 9 is a scheme of an experimental example of the electron gun according to the present invention.

FIG. 9 is a scheme showing the construction of an example of another electron gun fabricated on trial, in the case where the distance from the cathode side end of the electrode $G_{31}$ to the center position of the first deflection plates C is 2.0d. Since the first deflection plates C and D are located closer to the cathodes than in the preceding example, the separation position $p_S$ of the side beam $B_R$ from the center beam $B_G$ is brought closer to the screen than in the preceding example. In the present embodiment, the total length (distance from the cathode side end of the electrode $G_{31}$ to the screen side end of the second deflection plates) is 8.75d, which is equal to that used in the preceding example, owing to the fact that the length in the axial direction of the second deflection plates A and B is as small as 0.75d and the length of the fourth electrode is increased to 2.7d. Further, in the present embodiment, the length $l_D$ of the first deflection plate D is smaller than the length $l_C$ of the plate C.

Figure 10:
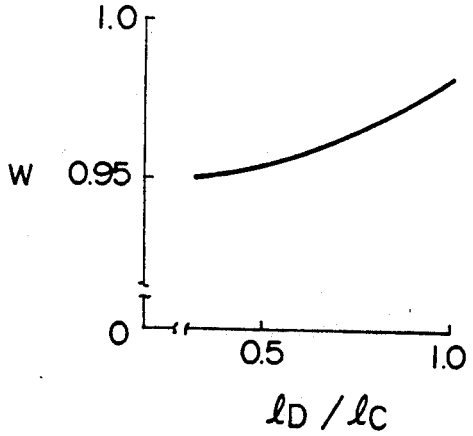
FIG. 10 is a scheme for explaining the action of the second deflection plates according to the present invention.

FIG. 10 indicates cross-section characteristics of a 2° diverging side beam $B_R$ advancing parallelly to the central axis Z from the Object point (position distant by 0.35d from the central axis, Z-axis, at the cathode side end of the electrode $G_{31}$), viewed at the position r directly before entering the main electron lens, i.e. position distant by 3.5d from the cathode side end of the electrode $G_{31}$. It shows variations in the ratio w of the vertical diameter (in the Y-direction perpendicular to the X-direction) to the horizontal diameter (in the X-direction) of the cross-section of the beam with respect to $l_D/l_C$, $l_C=1.8d$, $l_D$ being shortened. Every time $l_D/l_C$ is varied, the ratio of the voltages applied to the first deflection plates C and D is varied so that the side beam $B_R$ enters the main electron lens under the Fraunhofer condition. From the figure, it can be understood that the cross-section of the beam is elongated horizontally (long in the X-direction) by decreasing $l_D$. This means that it can compensate the astigmatism produced by the second deflection plates A and B (effect of elongating the cross-section of the beam vertically (long in the Y-direction)). As the result, even in the case where the electric field produced by the second deflection plates A and B is strengthened in order to have a good convergence by decreasing the length of the second deflection plates A and B, it is possible to compensate the astigmatism produced thereby by decreasing $l_D$. Consequently it is possible to decrease further the length of the second deflection plates A and B with respect to that required in the preceding example, keeping the total length as it is.

Figure 11:
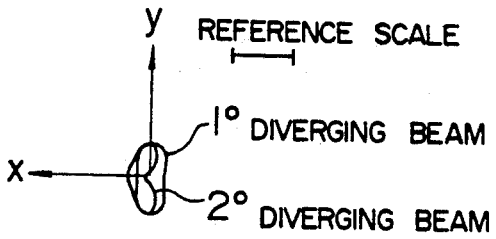
FIG. 11 is a scheme indicating the beam spot in an embodiment of the electron gun according to the present invention.

FIG. 11 shows the spot shape of the side beam (1° diverging beam and 2° diverging beam) on the screen in the state where the convergence and the focusing are realized in the following mode of realization in the embodiment indicated in FIG. 9. In the present example, normalized by the inner diameter d of the electrodes, the length of the electrode $G_{31}$ is 0.8d; the length of the deflection plates C $l_C=1.8d$; the length of the deflection plates D $l_D=0.6d$; the length of the electrode $G_{32}$ is 1.45d; the length of the fourth electrode $G_4$ is 2.7d; the length of the deflection plates A and B in the axial direction is 0.75d; the length from the cathode side end of the electrode $G_{31}$ to the screen side end of the second deflection plates is 8.75d; the space between the deflection plates A, B and the deflection plates C, D in the X-direction is 0.35d; and the distance from the cathode side end of the electrode $G_{31}$ to the screen is 36.4d. The ratio of the voltages given to the various electrodes is $V_{G31}:V_C:V_D:V_{G32}:V_{G4}:V_A:V_B=10:10:10.75:10:33.6:31.16:33.6$. In addition, since the second deflection plates C and D are inserted and the voltage $V_D$ applied to the deflection plates D is higher than the voltages $V_{G31}$ and $V_{G32}$ applied to the electrodes $G_{31}$ and $G_{32}$, the center beam is also influenced by the electric fields produced by the electrode $G_{31}$, the deflection plates D and the electrode $G_{32}$. For this reason, in the preceding example and the present example, as indicated in FIG. 2, two horizontal plates F are disposed between the two deflection plates D so as to be perpendicular to the deflection plates D and parallel to the Z-axis so that the electric fields in the X- and the Y-direction are identical to each other on the center beam in the region, where the deflection plates D are inserted.

Figure 12:
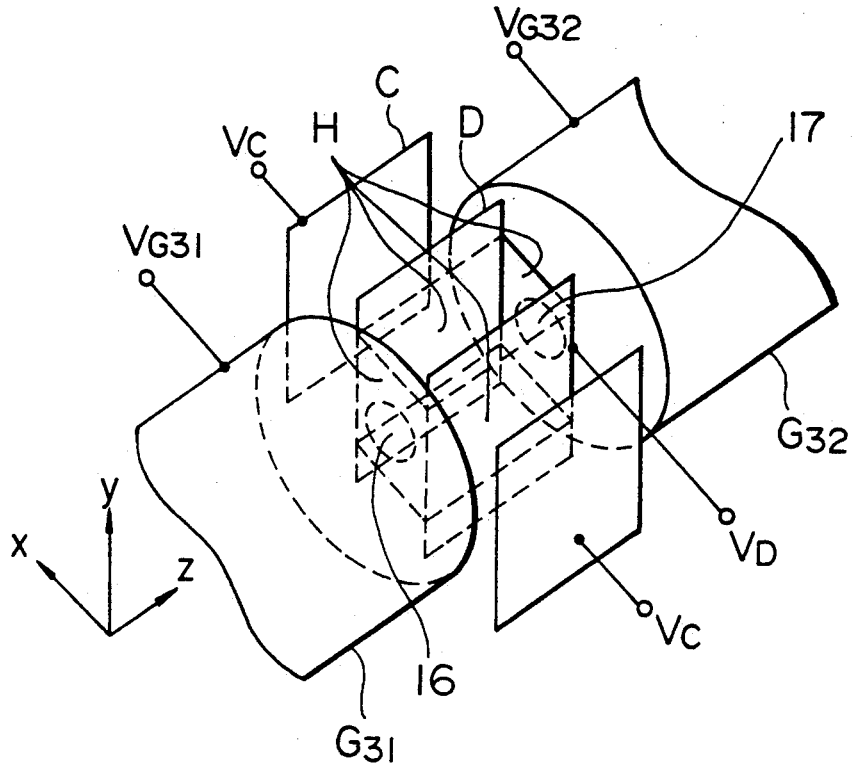
FIG. 12 is a perspective view showing the principal part of an embodiment of the electron gun according to the present invention.

FIG. 12 is an enlarged scheme of the part of the first deflection plates C and D in another embodiment of the electron gun according to the present invention. Between the two inner deflection plates D of the first deflection plates there are disposed two electrode plates H so as to connect them, the electrode plates H being perpendicular to the deflection plates D and parallel to the Z-axis, and electrode plates having apertures 16 and 17 on the surfaces of the electrode plates H and the deflection plates D opposite to the electrode $G_{31}$ and the electrode $G_{32}$, respectively. The center beam $B_G$ passes through these apertures 16 and 17. The voltages $V_{G31}$, $V_{G32}$ and $V_D$ are so determined that $V_{G31}=V_{G32}<V_D$ and the electrodes G31, D, H and $G_{32}$ form a focusing lens.

Figure 13:
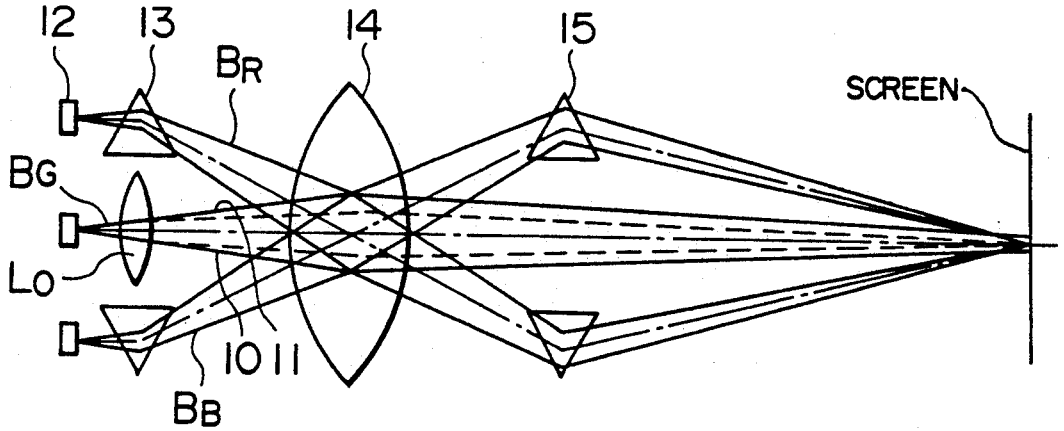
FIG. 13 is a scheme indicating an optically equivalent model of an electron gun according to the present invention, in which the principal part indicated in FIG. 12 is used.
Figure 14:
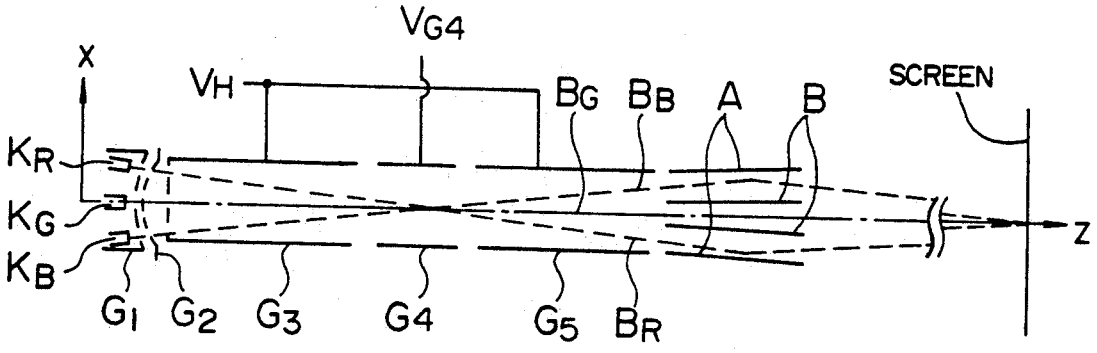
FIG. 14 (PRIOR ART)
FIG. 14 is a scheme indicating the construction of electrodes of a prior art electron gun.

FIG. 13 is a scheme indicating an optically equivalent model of the electron gun, which has the part indicated in FIG. 12, in which $L_0$ is a focusing lens constituted by the electrodes $G_{31}$, D, H and $G_{32}$; 12 denotes the triode part; 13 denotes the first deflection plates; 14 denotes the main electron lens; and 15 denotes the second deflection plates. The trajectory path of the center beam $B_G$ is shorter than the trajectory paths of the side beams $B_R$ and $B_B$. Consequently, if there were no effect of the focusing lens $L_0$, when the side beams $B_R$ and $B_B$ are focused on the screen, the center beam $B_G$ would advance as indicated by a full line 10 and thus it would be in a not focused state. In the embodiment indicated in FIG. 12 the center beam $B_G$ is subjected to the focusing action by the focusing lens $L_0$ and advances as indicated by a broken line 11. In this way the focusing point of the center beam $B_G$ can be in accordance with the focusing points of the side beams $B_R$ and $B_B$. Consequently it is possible to decrease the spot sizes of both the center beam and the side beams simultaneously.

In the above the electron gun fabricated on trial has been described. However these concrete numerical values represent only one example and it is obvious that the present invention can be realized, not limited to this example. Although a case where the bi-potential focusing lens is composed of two cylindrical electrodes has been indicated in the above, it may be composed of more than two cylindrical lenses. The present invention can be realized without impairing the essence thereof, if, in short, the main electron lens is constructed by a bi-potential lens and the electron beams can pass through the neighborhood of the center of the main electron lens by using electrostatic deflection plates disposed on the electron source side of the main electron lens.

Figure 15:
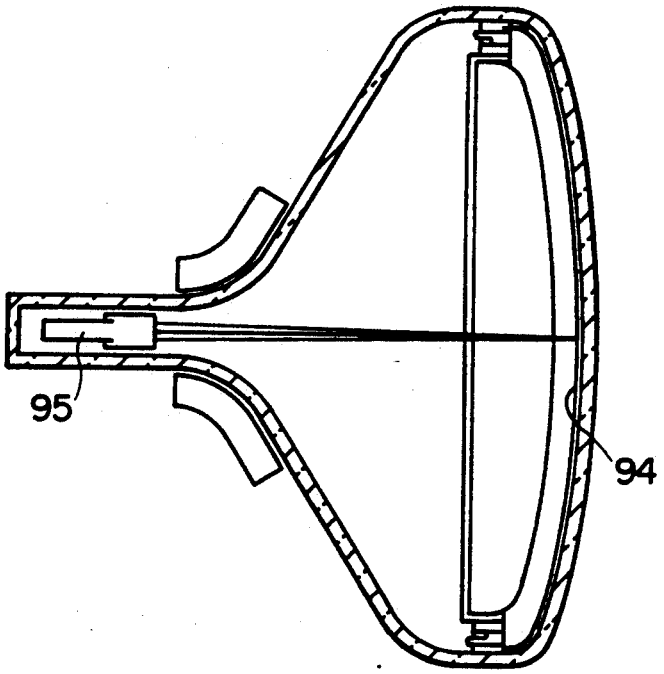
FIG. 15 is a cross sectional view of a cathode ray tube furnished with the electron gun of the invention.

As explained above, by using the electrode construction according to the present invention, it is possible to provide an electron gun having aberration characteristics more excellent than those obtained by using a prior art uni-potential focusing lens. As illustrated in FIG. 15, it is possible to obtain a high definition CRT having a small beam spot on the screen 94 by using an electron gun 95 structured according to the present invention so as to realize a superior high definition color imaging device remain almost identical to that of a prior art electron gun. Furthermore the center beam and the side beams can be emitted parallelly to each other without inclining the construction of the electron lens part for the triode part serving as the side beam generating part with respect to the central axis, as it is required heretofore. For this reason the fabricating process for the electrodes is not complicated and it is possible to provide an electron gun having a high fabrication precision.

I claim:

1. An electron gun targeting on a screen comprising:

a triode part controlling an electron source generating a plurality of electron beams and emission of the electron beams generated by said electron source;

a main electron lens of a bi-potential focusing type comprising not less than two cylindrical electrodes focusing said plurality of electron beams emitted by said triode part;

first electrostatic deflection plates disposed on an electron source side of said main electron lens; and second electrostatic deflection plates disposed on a screen side of said main electron lens.

2. An electron gun according to claim 1, wherein said first electrostatic deflection plates have means for applying a voltage to said first electrostatic deflection plates so that said first electrostatic deflection plates make said plurality of electron beams pass through the neighborhood of a center of said main electron lens.

3. An electron gun according to claim 1, further comprising means for applying the lowest voltage to an electrode closest to the electron source and the highest voltage to an electrode closest to the screen among said cylindrical electrodes.

4. An electron gun according to claim 1, wherein the first electrostatic deflection plates include a pair of inner electrode plates and a pair of outer electrode plates, and wherein the length in the axial direction of the inner electrode plates with respect to the axis of an acceleration tube through said first electrostatic deflection plates is set so as to be smaller than the length in the axial direction of the outer electrode plates.

5. An electron gun according to claim 1, wherein the distance in the axial direction between a center position of outer electrode plates of said first electrostatic deflection plates with respect to the axis of an acceleration tube through said first electrostatic deflection plates and a center position of said main electron lens is greater than 1.5 times of the inner diameter of the cylindrical electrodes comprising the main electron lens.

6. An electron gun according to claim 1, wherein the first electrostatic deflection plates include inner electrode plates and outer electrode plates with respect to the axis of an acceleration tube through said first electrostatic deflection plates and wherein the voltage applied to the outer electrode plates is equal to the lowest among the voltages applied to said cylindrical electrodes, and wherein the voltage applied to inner electrode plates is higher than the voltage applied to said outer electrode plates.

7. An electron gun according to claim 1, wherein the first electrostatic deflection plates include a pair of inner electrode plates and a pair of outer electrode plates with respect to the axis of an acceleration tube through said first electrostatic deflection plates, and wherein the inner electrode plates are connected with each other by means of two electrode plates, which are perpendicular to said inner electrode plates and symmetric with respect to the axis of the acceleration tube.

8. An electron gun according to claim 1, wherein inner electrode plates with respect to the axis of an acceleration tube between two pairs of electrodes constituting said first electrostatic deflection plates and electrode plates connecting said inner electrode plates are constructed so as to enclose center electron beams and each of electrode plates connecting said inner electrode plates and said electrode plates has an aperture, through which said center electron beams pass.

* * * * *